US006001531A

United States Patent [19]

Hasan et al.

[11] Patent Number: 6,001,531

[45] Date of Patent: Dec. 14, 1999

[54] PHOTOGRAPHIC PROCESSING COMPOSITION AND FILM UNIT

[75] Inventors: Fariza B. Hasan, Waltham; Daniel D. Huang, Wayland, both of Mass.

[73] Assignee: Polaroid Corporation, Cambridge, Mass.

[21] Appl. No.: 09/188,042

[22] Filed: Nov. 6, 1998

Related U.S. Application Data

[63] Continuation-in-part of application No. 08/997,217, Dec. 23, 1997, abandoned.

[51] Int. Cl.[6] ..... G03C 8/38

[52] U.S. Cl. ..... 430/212; 430/215; 430/220; 430/466

[58] Field of Search ..... 430/212, 215, 430/220, 466

[56] References Cited

U.S. PATENT DOCUMENTS

| | | | |
|---|---|---|---|
| 3,642,510 | 2/1972 | Sugiyama et al. | 106/445 |
| 3,833,369 | 9/1974 | Chiklis et al. | 430/220 |
| 4,235,768 | 11/1980 | Ritter et al. | 523/205 |
| 4,246,040 | 1/1981 | Okumura et al. | 106/444 |
| 4,680,247 | 7/1987 | Murphy | 430/212 |
| 5,422,233 | 6/1995 | Eckert et al. | 430/212 |

*Primary Examiner*—Hoa Van Le

*Attorney, Agent, or Firm*—Gaetano D. Maccarone

[57] ABSTRACT

The present invention relates to a photographic processing composition comprising an aqueous alkaline medium including titanium dioxide particles and a stabilizing agent comprising a polymer polymerized from repeating units of styrene and an acrylic acid. The presence of the stabilizing agent substantially reduces the settling out of the titanium dioxide particles in the subject processing composition, and maintains the substantially uniform distribution of titanium dioxide particles therein. The subject processing compositions are useful in photographic diffusion transfer film units and processes.

5 Claims, No Drawings

PHOTOGRAPHIC PROCESSING COMPOSITION AND FILM UNIT

CROSS-REFERENCE TO RELATED APPLICATIONS

This application is a continuation-in-part of prior application Ser. No. 08/997,217, filed Dec. 23, 1997, now abandoned.

The present invention relates to photographic processing compositions and film units, and processes for use in photographic diffusion transfer systems. More particularly, the subject invention relates to a novel photographic processing composition which includes an aqueous alkaline medium, titanium dioxide particles and a stabilizing agent for the titanium dioxide particles and to products and processes which utilize the composition.

BACKGROUND OF THE INVENTION

As is well known in the art, dispersions of visible light reflecting agents such as, for example, titanium dioxide, are generally added to aqueous alkaline solutions such as photographic processing compositions and to liquid organic media such as pigmented lacquers and plastic materials. It is known in the photographic art that titanium dioxide particles, due to their highly effective reflection properties, may be used to appreciably lessen or eliminate undesirable effects such as, for example, fogging. Likewise, in the paint industry, it is known to use a dispersion of titanium dioxide to influence the properties of the products in regard to hue, gloss and physical and chemical behavior.

Importantly, to realize the beneficial effects described above, the titanium dioxide particles comprising the dispersion must remain substantially dispersed, i.e., uniformly distributed, in the aqueous alkaline solutions or in the liquid organic media to which they are added.

U.S. Pat. 3,642,510 describes a process for preparing titanium oxide pigments which are dispersable in hydrophobic systems such as paints or varnishes by adding an alkali metal salt of a high molecular weight carboxyl compound to a titanium oxide slurry finely dispersed in water or an alcohol containing an aluminum salt or zinc salt to form a soap of aluminum or zinc on the surface of the titanium oxide.

U.S. Pat. 4,235,768 describes a process of coating a titanium dioxide pigment with an organic polymer containing carboxyl groups to produce a homogeneous dispersion of the pigment in liquid organic media, e.g., pigmented lacquers and plastic materials.

U.S. Pat. 4,246,040 describes a method of surface treating a powdery or granular solid substance such as titanium dioxide which comprises reacting a basic polyaluminum salt with an acid or its salt in the presence of the titanium dioxide to alter the hydrophilic or lipophilic properties of the titanium dioxide.

Methods are known in the art to alleviate or circumvent the undesirable results brought about by the settling, agglomeration and/or random adhesion of titanium dioxide particles in aqueous alkaline processing compositions, for example, by encapsulating the titanium dioxide particles such as disclosed in U.S. Pat. 3,833,369; or, by adding additional titanium dioxide particles to the processing composition, so that, in effect, the settling out of the titanium dioxide particles still occurs but the amount present overall provides suitable reflection.

As would be understood by those of skill in the relevant art, efforts to eliminate the settling of titanium dioxide particles in aqueous alkaline processing compositions can be difficult without detrimentally affecting the photographic quality of diffusion transfer film units. In other words, due to the complexity of the chemical interactions between the constituents of the processing composition, as well as, the interactions of the processing composition with the other components of the film unit, minor changes in the formulation of the processing composition can have a significant impact on the resulting photographic product.

As the state of the art advances, novel approaches continue to be sought in order to attain the required performance criteria for the systems described above. There is a need for novel photographic processing compositions that have advantages over those already known to the art; therefore, investigations continue to be pursued to provide such advantages.

It is therefore an object of this invention to provide a novel photographic processing composition for use in photographic diffusion transfer film units and processes.

It is another object of the present invention to provide diffusion transfer photographic film units and processes which include the novel processing compositions.

SUMMARY OF THE INVENTION

These and other objects and advantages are accomplished in accordance with the invention by providing a photographic processing composition which comprises an aqueous alkaline medium having therein titanium dioxide particles and a stabilizing agent for keeping the titanium dioxide particles substantially dispersed therein. The stabilizing agent comprises a polymer polymerized from a monomer system comprising repeating units of styrene and an acrylic acid.

Optionally, the stabilizer polymer may further comprise repeating units of other monomers. Such additional monomers include acrylates, aminoacrylates and ethylene or butadiene.

An advantage of the present invention is that the settling out of titanium dioxide particles in the processing composition is substantially reduced, i.e., the subject processing composition shows a substantially uniform distribution of titanium dioxide particles therein. Further, there are provided according to the present invention diffusion transfer photographic film units having improved photographic quality, i.e., the photographic quality of the images produced therewith, by substantially eliminating fogging due to light piping and the random adhesion of settled titanium dioxide particles to such film units, particularly, to the image-receiving layer incorporated therein. Another advantage provided by the present invention resides in the extended shelf-life of diffusion transfer film units according to the invention.

These and other objects and advantages which are provided in accordance with the invention will in part be obvious and in part be described hereinafter in conjunction with the detailed description of various preferred embodiments of the invention. The invention accordingly comprises the processes involving the several steps and relation and order of one or more of such steps with respect to each of the others, and the product and compositions possessing the features, properties and relation of elements which are exemplified in the following detailed disclosure, and the scope of the application of which will be indicated in the claims.

For a fuller understanding of the nature and objects of the invention, reference should be had to the following detailed description of the preferred embodiments.

DETAILED DESCRIPTION OF THE PREFERRED EMBODIMENTS

The present invention is directed toward photographic diffusion transfer products and processes. In general, diffusion transfer photographic products and processes involve film units having a photosensitive system including at least one silver halide layer, usually integrated with an image-providing material, e.g., an image dye-providing material. After photoexposure, the photosensitive system is developed outside the exposing apparatus, generally by uniformly distributing an aqueous alkaline processing composition over the photoexposed element, to establish an imagewise distribution of a diffusible image-providing material. The image-providing material is selectively transferred, at least in part, by diffusion to an image-receiving layer or element positioned in a superposed relationship with the developed photosensitive element and capable of mordanting or otherwise fixing the image-providing material. The image-receiving layer retains the transferred image for viewing. In diffusion transfer photographic products of the so-called "peel-apart" type, the image is viewed in the image-receiving layer upon separation of the image-receiving element from the photosensitive element after a suitable imbibition period. In diffusion transfer photographic products of the so-called "integral" type, such separation is not required.

As is well known in the art, processing compositions incorporated in diffusion transfer instant film units generally include a dispersion of a visible light reflecting agent, such as, for example, titanium dioxide particles, to prevent further exposure or fogging by actinic light incident on the applied layer of processing composition of the exposed film unit as the exposed film unit is developed in ambient light, having been removed from the exposing apparatus, e.g., instant camera. As would be appreciated by those of skill in the relevant art, materials dispersed within the processing compositions should remain substantially dispersed, i.e., uniformly distributed prior to use of the processing compositions, for example, while the diffusion transfer film unit sits on a shelf or in a camera.

As stated earlier, one may initiate photographic development of the exposed diffusion transfer film unit by applying the processing composition as the exposed film unit is advanced from the exposing apparatus into the light. This is readily accomplished, for example, by providing the processing composition in a rupturable container positioned in a processing relationship along a leading edge of the diffusion transfer film unit and adapted for spreading of its contents in a substantially uniform layer between selected layers of, e.g., the photosensitive element and the image-receiving element. Suitable pressure means, e.g., a pair of superposed rollers, are provided adjacent the exit passage of the exposing apparatus so that when the film unit is advanced therethrough into the light, the compressive force thus provided ruptures the container and causes spreading of the processing composition.

In this manner, as the film unit is brought out into the light, the processing composition containing the visible light reflecting agent has been applied so as to preclude fogging by actinic light incident on the applied layer of processing composition. By also incorporating suitable pH-sensitive optical filter agents, preferably pH-sensitive phthalein dyes, in the processing composition, such as, for example, those described in U.S. Pat. 3,647,347, the film unit may be ejected from the camera immediately after the processing composition has been applied with the process being completed in ambient light while the photographer watches the transfer image emerge.

However, by a phenomenon referred to as "light piping" it has been found that some fogging can occur along the rear portion of the diffusion transfer film unit, i.e., that portion last removed from the exposing apparatus. As would be understood by one of skill in the relevant art, the fogging is caused by light incident on that portion outside the camera being transmitted within the film unit into the camera to that portion of the film unit to which the processing composition has not yet been applied and, hence, is unprotected by the application of the visible light reflecting agent, generally, titanium dioxide particles.

More specifically, while light striking that portion of the film unit outside the camera generally does not fog those corresponding portions of the film unit, due to the presence of a visible light reflecting agent, a portion of this light may be reflected internally thus scattering or diffusing along the film unit to expose and, hence, fog that portion of the film unit still inside the camera to which the processing fluid has not yet been applied. Given the speed of light, efforts toward eliminating the undesirable effects of light piping have focused on the inclusion of various materials such as opacifying agents and the aforementioned visible light reflecting agents in the film unit. Accordingly, it is known in the art that various materials such as the aforementioned visible light reflecting agents, for example, titanium dioxide particles, due to their highly effective reflection properties, may be used to appreciably lessen or eliminate the aforementioned fogging phenomenon while not adversely affecting the quality of the image obtained by exposure therethrough, and that such materials may be supplied to the film unit in the processing composition and/or incorporated into the film unit as a layer.

For example, image-receiving elements particularly adapted for use in peel-apart diffusion transfer film units have typically embodied an image-receiving layer for retaining the transferred image arranged on a substrate layer of suitable material or a combination of layers arranged on the substrate layer, each of the layers providing specific and desired functions adapted to the formation of the desired photographic image in accordance with diffusion transfer processing. More particularly, in one well known embodiment the image-receiving clement typically comprises a support material, preferably, an opaque support material carrying a light-reflecting layer for the viewing of the desired transfer image thereagainst by reflection.

Diffusion transfer film units of the integral type generally include a light-reflecting layer including a light-reflecting pigment positioned in the laminate between the developed photosensitive layer or layers and the image-receiving layer which serves to mask the developed photosensitive layer or layers and provides a light-reflecting background against which the photographic image can be viewed. These layers are part of a permanent laminate which typically includes outer or support layers at least one of which is transparent to permit viewing therethrough of the photographic image.

As is well known in the relevant art, the light-reflecting layer incorporated in a diffusion transfer film unit may be provided as a coated layer or as a result of the spreading between the photographic emulsion layer(s) and the image-receiving layer of the film unit of a processing composition including the light-reflecting pigment, i.e., the layer of processing composition distributed during processing of the film unit forms the light-reflecting layer. More particularly, the light-reflecting layer is formed by the solidification of the stratum of processing composition distributed after exposure, i.e., the evaporation of water from the applied layer of processing composition results in a solidified light-reflecting layer which permits the viewing thereagainst of the image-receiving layer through a transparent support.

In addition, the light-reflecting layer formed by the solidification of the processing composition as described above may also be designed to bond the layers of the film unit together to form a photographic laminate, including a temporary or a permanent laminate.

The present invention is particularly concerned with the nature of the photographic processing composition utilized in the photographic film units of the invention. In particular, it will be understood by those of skill in the art that, in order for the titanium dioxide particles of a processing composition or a coated layer to reflect rather than randomly scatter the actinic light incident on the film unit, the titanium dioxide particles should be substantially uniformly distributed throughout the processing composition and/or layer of the film unit. Accordingly, the shelf life, e.g., of a diffusion transfer film unit containing a rupturable container which includes titanium dioxide in its processing composition, would be shortened if the titanium dioxide particles settled out of the processing composition, resulting in a non-uniform distribution of visible light reflecting material less able to substantially reduce or preclude the deleterious effects of light piping.

The novel photographic processing composition of the invention comprises an aqueous alkaline medium, light reflecting particles such as titanium dioxide particles and a polymeric stabilizing agent. The polymeric stabilizing material utilized according to the invention comprises a polymer polymerized from a monomer system comprising repeating units of styrene and an acrylic acid. According to a preferred embodiment the stabilizer material may further include repeating units of other monomers such as acrylates, aminoacrylates and ethylene or butadiene.

According to a preferred embodiment, the stabilizing agent may be represented by the formula

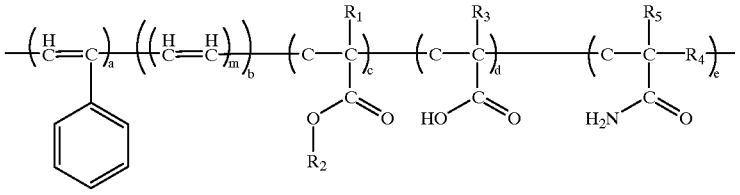

(I)

wherein:

$R_1$, $R_3$, and $R_5$ are each independently a hydrogen atom or alkyl, represented by $C_n$, $H_{2n+1}$ where n is an integer of from 1 to 4;

$R_2$ is alkyl represented by $C_pH_{2p+1}$ where p is an integer of from 1 to 10;

$R_4$ is alkyl represented by $C_qH_{2q+1}$ where q is an integer of from 1 to 12;

a is an integer of from about 500 to about 20,000;

b is an integer of from 0 to about 14,000;

c is an integer of from 0 to about 6000;

d is an integer of from about 50 to about 1000;

e is an integer of from 0 to about 6000; and m is 1 or 2.

Thus, the stabilizing agents according to Formula I may comprise from about 500 to about 20,000 repeating units of styrene, from 0 to about 14,000 repeating units of ethylene or butadiene, from 0 to about 6000 repeating units of an acrylate, from about 50 to about 1000 repeating units of an acrylic acid and from 0 to about 6000 repeating units of an aminoacrylate. Such stabilizing agents include from about 30 to about 90%, by weight, styrene, from about 1 to about 10% by weight of an acrylic acid, from 0 to about 70% by weight of ethylene or butadiene, from 0 to about 30% by weight of an acrylate and from 0 to about 10% by weight of an aminoacrylate. In a particularly preferred embodiment according to the invention the stabilizing agent comprises a terpolymer comprising repeating units of styrene, an acrylic acid and butadiene (formula I where m is 2, c is 0, e is 0).

The polymeric stabilizing materials are random copolymers and can be prepared by reacting the monomers in aqueous solution in the presence of a surfactant and an initiator in accordance with well known reaction techniques. Accordingly, the polymer particles are obtained as a latex dispersion in the aqueous medium.

As is apparent from the repeating units of the subject polymer, the polymeric stabilizer materials are latex particles with acidic functional groups, specifically, carboxylate groups, on the surface. Carboxylate groups ionize in an aqueous alkaline medium, i.e., from about pH 11 to about pH 14. Further, the more ionic the stabilizing agent of formula (I), the greater the affinity of its ions for, e.g., the surfaces of titanium dioxide particles and, consequently, the more effective is its dispersive action.

Although there is no intention to be bound by any particular theory since the advantages provided by the photographic processing composition of the invention have been shown by extensive experimentation, it is thought that the stabilizing agent, by virtue of the carboxylate groups on its surface, facilitates the substantially uniform distribution of titanium dioxide particles in the processing composition.

As is well known in the art, titanium dioxide particles dispersed in water are most stable at about pH 11 because the maximal repulsion, i.e., the zeta potential (ZP), between charged titanium dioxide particles which is indicative of the surface charge of the titanium dioxide particles, is lowest, i.e., most negative, at about pH 11:

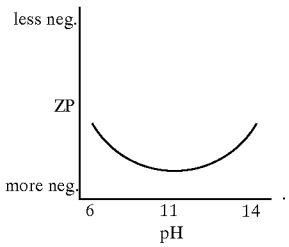

Hence, while any suitable method of preparing the subject aqueous alkaline processing composition may be used in the present invention, a preferred method for preparing the processing composition purports to take advantage of the aforementioned ZP by including a step which preincubates the titanium dioxide particles with the subject stabilizing agent(s) in an aqueous alkaline solution of about pH 11. As mentioned above, it is thought that the maximal repulsion between charged titanium dioxide particles at about pH 11 facilitates diminished self-association of the titanium dioxide particles, and thus, greater interaction with the stabilizing agent, specifically, with the negatively charged, i.e., ionized, carboxylate groups on the surface of the stabilizing agent.

The polymeric materials of formula (I) are stable in a highly alkaline environment, i.e., above about pH 10, and more particularly, at about pH 12–14 which is the pH generally used for photographic development. The particle size of the polymers is preferably from about 50 to about 1000 nm. In addition, the particles are discrete and homogeneous, as well as substantially buoyant or suspendable, in aqueous alkaline media, e.g., aqueous alkaline photographic processing compositions.

The polymer particles favorably interact with titanium dioxide particles, i.e., the particles are suitably adsorbed to the surfaces of the titanium dioxide particles in part, due to desirable Brownian motion. The density of the polymeric particles adsorbed to a titanium dioxide particle provides a desirable effective density, i.e., the density of the combined latex and titanium dioxide particles is substantially similar to that of the media, i.e, water, within which the particles are is suspended.

The stabilizing agents of formula (I) may be prepared using any technique, including techniques which are well known to those of skill in organic chemistry and in the polymer art, such as, for example, those methods described in *Textbook of Polymer Science, Part III Polymerization,* Fred. W. Billmeyer, Jr., Interscience Publishers, 1962. As would be understood by those of skill in the art, the polymerization of the repeating units may be a random polymerization or may be controlled to the extent desired. As can be seen from formula (I), the stabilizing agent of the present invention includes repeating units of styrene and an acrylic acid, and, if desired, also may include repeating units of ethylene or a diene, acrylate, and aminoacrylate as so desired for any particular application. Any suitable order of repeating units may be used in the stabilizing agent.

In addition, compounds within the scope of formula (I) are commercially available, for example, from S.C. Johnson Wax (Racine, Wis.) under the tradename Joncryl 87, from Goodyear Chemical (Akron, Ohio) under the tradename Pliolite LPF-6733, from BASF Corporation (Mount Olive, N.J.) under the tradename Polystyrol-500, and from the Kumho Chemical Company (Yuseong, Taejeon, Korea) under the tradename Kumho-Kosyn KSL 100, 200, 300 and 600 series.

The amount of the stabilizing agent(s) necessary in any specific instance is dependent upon a number of factors, such as, for example, the amount of titanium dioxide particles in the aqueous alkaline solution, the type of diffusion transfer film unit within which the processing composition prepared according to the invention will be incorporated, and the result desired, e.g., substantially less, if any, light piping, fogging, and settling of titanium dioxide particles onto the image-receiving layer of the film unit.

Routine scoping tests may be conducted to ascertain the concentration of titanium dioxide particles and stabilizing agent(s) which are appropriate for any given application. For example, in a preferred embodiment a suitable amount of stabilizing agent(s) may be chosen from among the parameters provided herein to result in a reflecting layer, provided by the processing composition, specifically, by the titanium dioxide particles included therein, which yields a percent reflectance of from about 85% to about 90%.

Preferred weight ratios of titanium dioxide particles to stabilizing agent are from about 1:5 to about 1:0.2. Particularly preferred weight ratios of titanium dioxide particles to stabilizing agent are from about 1:2.5 to about 1:0.5. Especially preferred weight ratios of titanium dioxide particles to stabilizing agent are from about 1:1.5 to 1:1.

Where the processing composition provided according to the invention is incorporated in a diffusion transfer film unit of the peel-apart type, the processing composition typically includes from about 0.01% to about 5%, by weight, of titanium dioxide particles. In a preferred embodiment the processing composition includes from about 0.02% to about 0.1% by weight of titanium dioxide particles and from about 0.02% to about 0.5% by weight of stabilizing agent. In another preferred embodiment the processing composition includes about 0. 1% by weight of titanium dioxide particles and about 0.05% by weight of stabilizing agent.

As mentioned previously, and as illustrated in formula 1, the stabilizing agents utilized according to the invention include repeating styrene groups and acrylic acid groups and optionally include ethylene or butadiene groups, acrylate groups and aminoacrylate groups. In preferred embodiments of the invention, the stabilizing agents include from about 1000 to about 10,000 repeating units of styrene (a is an integer of from about 1000 to about 10,000), from about 200 to about 2000 repeating units of ethylene or butadiene (b is an integer of from about 200 to about 2000), from 0 to about 1000 repeating units of acrylate (c is an integer of from 0 to about 1000), from about 100 to about 500 repeating units of an acrylic acid (d is an integer of from about 100 to about 500) and from 0 to about 1000 repeating units of aminoacrylate (e is an integer of from 0 to about 1000). A particularly preferred stabilizing agent according to the invention comprises from about 3.5% to about 4% by weight of an acrylic acid, from about 56% to about 56.5%, by weight, of butadiene and about 40% by weight of styrene.

The processing compositions of the present invention are aqueous alkaline compositions having a pH in excess of about 10, and frequently in the order of about 14. For film unit applications requiring pH values in the range of about 12 to about 14, alkaline materials such as, for example, sodium hydroxide or potassium hydroxide may be used. For applications requiring pH values in the range of about 10 to about 12, alkaline materials such as, for example, sodium carbonate, potassium carbonate or borates may be used. The subject processing compositions preferably include potassium hydroxide.

As stated earlier, the subject processing composition may be incorporated in any suitable diffusion transfer photographic system, including those relating to both peel-apart and integral film products and processes. Photographic products and processes of the diffusion transfer type are well known and have been described in numerous patents, including, for example, U.S. Pat. Nos. 2,983,606; 3,345,163; 3,362,819; 3,415,644; 3,594,164; 3,594,165; 3,647,437; 3,719,489; 4,098,783; 4,322,489; 4,740,448; 5,320,929; 5,415,970; and 5,569,574. The arrangement and the order of the individual layers of the film units used in such processes can vary in manners known in the art.

The subject processing composition may be used during the photographic processing of any exposed photosensitive element including photographic systems for forming images in black and white or in color and those wherein the final image is a metallic silver or one formed by other image-forming materials.

Processing compositions, specifically, the components therein, for use in diffusion transfer photographic systems are well known in the art and, therefore, extensive discussion of such processing compositions is not necessary. See, for example, U.S. Pat. Nos. 2,635,048; 2,644,756; 3,173,786; 3,351,465; 3,353,956; 3,386,825; 3,455,685; 3,579,333; 3,597,197; 3,619,155; 4,144,065; 4,168,166; 4,202,694; 4,248,955; 4,255,512; 4,267,255; 4,276,370; 4,324,853; 4,353,976; 4,680,247; 4,756,996; 4,496,651; 5,422,233; 5,571,656; 5,591,560; 5,593,809; 5,593,810; and 5,604,079.

Briefly, the subject processing compositions may additionally include known silver halide developing agents, development restrainers, opacification dyes, tint dyes and other photographic agents typically included in such compositions. As will be understood by those of skill in the art, the selection of constituents of the processing composition along with dyes and other components of the film unit, are generally dependent upon the pH environment of the film unit. A preferred processing composition for a peel-apart type film unit at a pH value of about 12 to about 14 is shown in TABLE I herein. As will be appreciated by those of skill in the art, processing compositions for peel-apart film units will generally not include opacification dyes but may include small quantities of light-reflecting pigments.

As is well known in the art, the photographic processing compositions can be incorporated into rupturable or frangible containers to facilitate spreading in diffusion transfer processing. Examples of suitable rupturable containers and their methods of manufacture can be found, for example, in U.S. Pat. Nos. 2,543,181; 2,634,886; 3,653,732; and 3,056,491.

The stabilization of titanium dioxide particles in an aqueous alkaline processing composition by the stabilizing agent of the present invention results in the substantially uniform distribution of the titanium dioxide particles within the processing composition which is then, as the film unit is advanced through the exposure apparatus into the light, spread in a substantially uniform layer between selected layers of the photosensitive and image-receiving elements, eliminating the undesirable consequence of light piping, i.e., fogging, without adversely affect the quality of the image, e.g., dye transfer is not hindered nor is there any undesirable effect on other sensitometric signals, rheological properties or spreading of the processing composition from the ruptured container.

As mentioned earlier, although it is not completely understood, and it is not our wish to restrict ourselves to any particular theory as to how the stabilizing agent substantially maintains the titanium dioxide particles in suspension within the processing composition, it is thought that the use of a latex polymer which, in turn, becomes a latex particle, i.e., comprises titanium dioxide particles, with the surface properties of a ball, functions as a buoyancy agent, i.e., affords water solubility to a very large molecule by virtue of its overall low density. It is also thought that the increased stability of the titanium dioxide particles within the processing composition of the invention, is due, in part, to the steric hindrance of inter-titanium dioxide particle contact, as well as, to the above-described ionic bond formation between the carboxyl groups of the stabilizing agent and the titanium dioxide particles.

The stabilized titanium dioxide particles according to the invention, without the remainder of the components of the processing composition, may also be incorporated in an image-recording material, e.g., a diffusion transfer film unit, as a component of a coating fluid, e.g., the opacifying fluid, used to produce the image-recording material, as well as, to other locations within the film unit, in addition to or instead of in the processing composition.

As stated earlier, the aqueous alkaline processing composition of the invention may be used in conjunction with any photographic emulsion. In the preferred diffusion transfer film units of the invention, it is preferred to include a negative working silver halide emulsion, i.e., one which develops in the areas of exposure.

Further, the processing compositions of the invention may be used in association with any image dye-providing materials, for example, complete dyes or dye intermediates, e.g., color couplers, or dye-developers. I)ye developers contain, in the same molecule, both the chromophoric system of a dye and a silver halide developing function as is described, for example, in U.S. Pat. 2,983,606.

In a preferred embodiment the image-recording material, e.g., diffusion transfer photographic film unit, of the invention includes one or more image dye-providing materials which may be initially diffusible or nondiffusible.

In diffusion transfer photographic systems the image dye-providing materials which can be utilized generally may be characterized as either (1) initially soluble or diffusible in the processing composition but which are selectively rendered nondiffusible imagewise as a function of development; or (2) initially insoluble or nondiffusible in the processing composition but which selectively provide a diffusible product imagewise as a function of development. The requisite differential in mobility or solubility may be obtained, for example, by a chemical reaction such as a redox reaction as is the case with dye developers, a coupling reaction or by a silver-assisted cleavage reaction as is the case with thiazolidines. As noted previously, more than one image-forming mechanism may be utilized in multicolor diffusion transfer film units.

Other suitable image dye-providing materials include, for example, those described in U.S. Pat. Nos. 2,087,817; 3,227,550; 3,433,939; 3,719,489; 3,725,062; 4,076,529; 5,569,574; 5,593,810; 5,571,656; 5,591,560; 5,593,809; 5,593,810; and 5,604,079. Particularly preferred subtractive multicolor diffusion transfer film units according to the invention include, as image dye-providing materials, both dye developers and dye-providing thiazolidine compounds, for example, as described in U.S. Pat. 4,740,448 wherein the cyan and magenta image dyes are dye developers and the yellow image dye is a thiazolidine.

Particularly preferred diffusion transfer photographic film units according to the invention are those intended to provide multicolor dye images. A particularly preferred type of diffusion transfer film unit according to the invention is that where the image-receiving element is designed to be separated from the photosensitive element after exposure and photographic processing has been completed—the so-called peel-apart type, such as, for example, those described in U.S. Pat. Nos. 5,571,656; 5,591,560; 5,593,809; 5,593,810; and 5,604,079. However, the diffusion transfer film units according to the invention may also be of the so-called integral type where the entire film unit is maintained together, such as, for example, described in U.S. Pat. 3,415,644.

Briefly, for example, a preferred embodiment of a photographic diffusion transfer film unit wherein the image-receiving element is designed to be separated from the photosensitive element after exposure and photographic processing typically includes: (1) a photosensitive element comprising a support carrying at least one silver halide emulsion layer; (2) a second sheet-like element which is superposed or superposable on the photosensitive element; (3) an image-receiving layer positioned in one of the photosensitive or second sheet-like elements, and (4) a rupturable container releasably holding an aqueous alkaline processing composition prepared according to the novel method disclosed herein, and so positioned as to be adapted to distribute said processing composition between predetermined layers of said elements. Such rupturable containers or "pods" are common in the art, and generally define the means for providing the processing composition to the photosensitive element and image-receiving element.

Further, the photosensitive element preferably includes an image dye-providing material in association with said silver halide emulsion layer(s). Moreover, the photosensitive element preferably includes a red-sensitive silver halide emulsion having a cyan image dye-providing material associated therewith, a green-sensitive silver halide emulsion layer having a magenta image dye-providing material associated therewith and a blue-sensitive silver halide emulsion layer having a yellow image dye-providing material associated therewith. The image dye-providing material is capable of providing, upon processing, a diffusible dye which is capable of diffusing to the image-receiving layer as a function of exposure.

As described previously, preferred photographic diffusion transfer film units are intended to provide multicolor dye images and the photosensitive element is preferably one capable of providing such multicolor dye images. The expression "color" used herein includes the combination of three dyes to result in black. In a preferred black and white embodiment, the image-forming material utilized is complexed silver which diffuses from the photosensitive element to the image-receiving layer during processing. As stated earlier, both such photosensitive systems are well known in the art, hence, they need not be described in lengthy detail herein.

The preferred second sheet-like element or image-receiving element mentioned above comprises a support carrying a polymeric acid-reacting layer, a timing (or spacer) layer and an image-receiving layer. Each of the layers carried by the support functions in a predetermined manner to provide desired diffusion transfer photographic processing as is known in the art, and any suitable material may be used in the polymeric acid-reacting layer, the timing layer or the image-receiving layer.

It should also be understood that the image-receiving element may include additional layers such as a strip-coat layer which is designed to facilitate the separation of the image-receiving layer from the photosensitive element after photographic processing as described in U.S. Pat. Nos. 4,009,031; 5,346,800; and 5,591,560; and/or one or more overcoat layers, for example, as described in U.S. Pat. No. 5,415,969, as is known in the art.

Support material can comprise any of a variety of materials capable of carrying the other layers of image-receiving element. Paper, vinyl chloride polymers, polyamides such as nylon, polyesters such as polyethylene terephthalate, or cellulose derivatives such as cellulose acetate or cellulose acetate-butyrate, can be suitably employed. The side of the support opposite the photosensitive or image-receiving layers may be coated with a layer to protect against, e.g., the sticking together of finished photographs in a stack, to provide a white surface and/or to counterbalance coat curl forces.

Depending upon the desired nature of the finished photograph, the nature of support material as a transparent, opaque or translucent material will be a matter of choice. Typically, an image-receiving element adapted to be used in peel-apart diffusion transfer film units and designed to be separated after processing will be based upon an opaque support material. The support will be a transparent support material where the processing of a photographic transparency is desired.

In one embodiment where the support material is a transparent sheet material, an opaque sheet (not shown), preferably pressure-sensitive, can be applied over the transparent support to permit in-light development. Upon photographic processing and subsequent removal of the opaque pressure-sensitive sheet, the photographic image diffused into image-bearing layer can be viewed as a transparency.

In another embodiment where support material is a transparent sheet, opacification materials such as carbon black and titanium dioxide can be incorporated in the processing composition, such as in the present invention described herein, to permit in-light development.

As mentioned previously, preferably, the image-receiving element of the invention includes a polymeric acid-reacting layer. The polymeric acid-reacting layer can be applied to the image-receiving element, if desired, by coating the support layer with an organic solvent-based or water-based coating composition. A polymeric acid-reacting layer which is typically coated from an organic-based composition comprises a mixture of a half butyl ester of polyethylene/maleic anhydride copolymer with polyvinyl butyral. A suitable water-based composition for the provision of a polymeric acid-reacting layer comprises a mixture of a water soluble polymeric acid and a water soluble matrix, or binder, material. Suitable water-soluble polymeric acids include ethylene/maleic anhydride copolymers and poly(methyl vinyl ether/maleic anhydride). Suitable water-soluble binders include polymeric materials such as polyvinyl alcohol, partially hydrolyzed polyvinyl acetate, carboxymethyl cellulose, hydroxyethyl cellulose, hydroxypropyl cellulose, polymethylvinylether or the like, for example, as described in U.S. Pat. 3,756,815.

The polymeric acid-reacting layer reduces the environmental pH of the film unit, subsequent to transfer image formation, and may comprise any suitable material, such as, for example, those materials described in U.S. Pat. Nos. 3,362,819; 3,754,910; 3,756,815; 3,819,371; and 3,833,367. The acid-reacting reagent is preferably a polymer which contains acid groups, e.g., carboxylic acid or sulfonic acid groups, which are capable of forming salts with alkaline metals or with organic bases, or potentially acid-yielding groups such as anhydrides or lactones. Preferred polymers comprise such polymeric acids as cellulose acetate hydrogen phthalate; polyvinyl hydrogen phthalate; polyacrylic acid; polystyrene sulfonic acid; and maleic anhydride copolymers and half esters thereof. In a particularly preferred embodiment, the polymeric acid-reacting layer comprises a vinyl acetate ethylene latex, and a free acid of a copolymer of methyl vinyl ether and maleic anhydride.

As stated earlier, preferably, the image-receiving element of the invention includes a timing layer. A timing layer can control the initiation and the rate of capture of alkali by the acid-reacting polymer layer. The timing layer may be designed to operate in a number of ways. For example, the timing layer may act as a sieve, slowly metering the flow of alkali there through, for example, as disclosed and claimed in U.S. Pat. 5,593,810. Alternatively, the timing layer may serve a "hold and release" function; that is, the timing layer may serve as an alkali impermeable barrier for a predetermined time interval before converting in a rapid and quantitatively substantial fashion to a relatively alkali permeable condition, upon the occurrence of a predetermined chemical reaction. Additional examples of suitable materials for use as timing layers are, for example, those described in U.S. Pat. Nos. 3,575,701; 4,201,587; 4,288,523; 4,297,431; 4,391,895; 4,426,481; 4,458,001; 4,461,824; and 4,547,451.

In a preferred embodiment of the invention the subject processing composition is incorporated in a diffusion transfer photographic film unit which comprises a photosensitive element and an image-receiving element which includes an image-receiving layer thereon, the image-receiving layer is designed for receiving an image-forming material which diffuses in an imagewise manner from the photosensitive element during processing, and the image-receiving layer may comprise any suitable material, e.g., a dyeable material which is permeable to the alkaline processing composition such as polyvinyl alcohol together with a polyvinyl pyridine polymer such as poly(4-vinyl pyridine), for example, as described in U.S. Pat. No. 3,148,061, and, in copending, commonly assigned U.S. Pat. application, Ser. No. 08/843,817, filed on Apr. 21, 1997.

Another suitable image-receiving layer material comprises a graft copolymer of 4-vinyl pyridine and vinylbenzyltrimethylammonium chloride grafted onto hydroxyethyl cellulose, as described in U.S. Pat. Nos. 3,756,814 and 4,080,346. Suitable mordant materials of the vinylbenzyltrialkylammonium type are described, for example, in U.S. Pat. 3,770,439.

For example, suitable mordant materials of the vinylbenzyltrialkyl-ammonium type are described, for example, in U.S. Pat. 3,770,439. Mordant polymers of the hydrazinium type (such as polymeric mordants prepared by quaternization of polyvinylbenzyl chloride with a disubstituted asymmetric hydrazine) can be employed. Such mordants are described in Great Britain Pat. No. 1,022,207, published Mar. 9, 1966. One such hydrazinium mordant is poly(1-vinylbenzyl 1,1-dimethylhydrazinium chloride) which, for example, can be admixed with polyvinyl alcohol for provision of a suitable image-receiving layer.

Yet another suitable mordant material for use in an image-receiving layer is a terpolymer comprising trimethyl-, triethyl- and tridodecyl-vinylbenzylammonium chloride, for example, as described in U.S. Pat. Nos. 4,794,067; 5,591,560; and 5,593,809.

In a particularly preferred embodiment of the present invention, the image-receiving layer comprises a terpolymer of vinylbenzyltrimethylammonium chloride, vinylbenzyltriethylammonium chloride and vinylbenzyldimethyldodecylammonium chloride, and a fully hydrolyzed polyvinyl alcohol.

In a preferred embodiment the image-receiving element comprises a support material, i.e., an opaque material carrying a light-reflecting layer for the viewing of the desired transfer image thereagainst by reflection, a polymeric acid-reacting layer adapted to lower the environmental pH of the film unit subsequent to substantial transfer image formation, a spacer or timing layer to slow the diffusion of the alkali of the subject aqueous alkaline processing composition toward the polymeric acid-reacting layer, and an image-receiving layer to receive the transferred photographic image.

As noted previously, in a preferred embodiment of the present invention, the subject aqueous alkaline processing compositions are incorporated into black and white diffusion transfer film units, such as, for example, those described in U.S. Pat. Nos. 3,567,442; 3,390,991; and 3,607,269; and, in E. H. Land, H. G. Rogers. and V. K. Walworth, in J. M. Sturge, ed., *Neblette's Handbook of Photography and Reprography,* 7th ed., Van Nostrand Reinhold, New York, 1977, pp. 258-330.

In a preferred black and white embodiment, a photosensitive element including a photosensitive silver halide emulsion is exposed to light and subjected to an aqueous alkaline processing composition prepared according to the invention disclosed herein, a silver halide developing agent which reduces exposed silver halide to an insoluble form, and a silver halide solvent which solubilizes the unexposed silver halide or image-forming material facilitating its diffusion from the photosensitive element to the image-receiving layer during processing. Accordingly, the image-receiving layer utilized in such a black and white embodiment typically includes a silver precipitating material wherein the soluble silver complex is precipitated or reduced to form a visible silver black and white image, as is well known in the art.

The invention will now be described further in detail with respect to specific preferred embodiments by way of examples, it being understood that these are intended to be illustrative only and the invention is not limited to the materials, conditions, process parameters, etc. recited therein. All parts and percentages recited are by weight unless otherwise stated.

EXAMPLE I

Stabilization of Titanium Dioxide Dispersions

Five dispersions were prepared: "Test-1," "Test-2," "Test-3" and "Test-4" were prepared according to the invention, and "Control-1" was prepared in the same overall manner as the four "test" dispersions but without the stabilizing agent.

The stabilizing agent comprised repeating units of acrylic acid (about 3–4%) and styrene (about 70–80%), at a weight ratio of about 1:20, and was purchased from S. C. Johnson Wax (Racine, Wis.) under the tradename Joncryl 87.

The four test dispersions were prepared by adding the stabilizing agent to an aqueous alkaline solution of potassium hydroxide at about pH 14, and then combining that solution with an aqueous alkaline solution of potassium hydroxide containing titanium dioxide particles at about pH 11 and raising the pH of the resultant dispersion to about pH 14. The resultant dispersions, namely, "Test-1," "Test-2," "Test-3" and "Test-4" included about 0.1% by weight of titanium dioxide particles and about 0.02%, 0.05%, 0.1% or 0.2%, by weight, respectively, of the stabilizing agent.

The "Control-1" dispersion was prepared by adding titanium dioxide particles to an aqueous alkaline solution of potassium hydroxide at about pH 11, and then raising the pH of that solution to about pH 14. The resultant dispersion included about 0.1% by weight of titanium dioxide particles.

The degree of settling out and/or agglomeration of the titanium dioxide particles in the five dispersions was measured by both visual settling and turbidimetric analysis, i.e.,

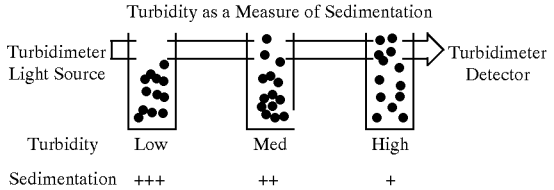

The visual settling (+++, ++, + or none) and the turbidity of the five dispersions were measured as indicated above, and the results are reported in TABLE I, wherein $TiO_2$ is titanium dioxide, "NTU" represents a nephelometric turbidity unit, and, as would be understood by those of skill in the art, the lower the NTU value, the greater the sedimentation of the titanium dioxide particles.

TABLE I

| DISPERSION | STABILIZING AGENT | VISUAL SETTLING | TURBIDITY (NTU) |
|---|---|---|---|
| Control-1 | none | +++, rapidly | about 0.2 |
| Test-1 | about 0.02% | ++ | about 88 |
| Test-2 | about 0.05% | + | about 265 |
| Test-3 | about 0.10% | none | about 498 |
| Test-4 | about 0.20% | none | about 798 |

As will be understood by the data of TABLE I, the titanium dioxide dispersions prepared according to the novel method of the present invention show significantly less sedimentation, as indicated by the substantially higher turbidity values, than the dispersion prepared in the same overall manner but without a stabilizing agent of the invention.

EXAMPLE II

Diffusion Transfer Photographic Film Units Including the Subject Processing Compositions Two diffusion transfer photographic film units of the peel-apart type were prepared: "Test-5" which was prepared according to the present invention using an aqueous alkaline processing composition which included about 0.1% by weight of titanium dioxide particles and about 0.1% by weight of stabilizing agent, Joncryl 87; and, "Control-2" film unit, i.e., a film unit prepared in the same overall manner as Test-5 but wherein the aqueous alkaline processing composition did not contain the stabilizing agent.

hol and I part of an aqueous polymeric emulsion, i.e., aliphatic polyester urethane polymer commercially available under the tradename Bayhydrol PU-402A (Bayer);

3. an image-receiving layer coated at a coverage of about 3228 mg/m$^2$ comprising: 2 parts of a terpolymer comprising vinylbenzyltrimethylammonium chloride, vinylbenzyltriethylammonium chloride and vinylbenzyldimethyldodecyl-ammonium chloride (6.7/3.3/1 weight %, respectively) and 1 part AIRVOL™ 425 (a fully hydrolyzed polyvinyl alcohol from Air Products Co.); and
4. a strip coat layer coated at a coverage of about 134 mg/m$^2$ comprising about 40% by weight of a terpolymer of acrylic acid, hydroxypropyl methacrylate and 4-vinylpyrrolidone and about 60% by weight of carboxymethyl guar.

Diffusion transfer photographic film units which include the polyester urethane polymer described above are disclosed and claimed in U.S. Pat. 5,593,810.

The photosensitive elements utilized in the diffusion transfer photographic film units comprised an opaque subcoated polyethylene terephthalate photographic film base carrying in succession:

1. a cyan dye developer layer comprising about 807 mg/m$^2$ of the cyan dye developer represented by the formula

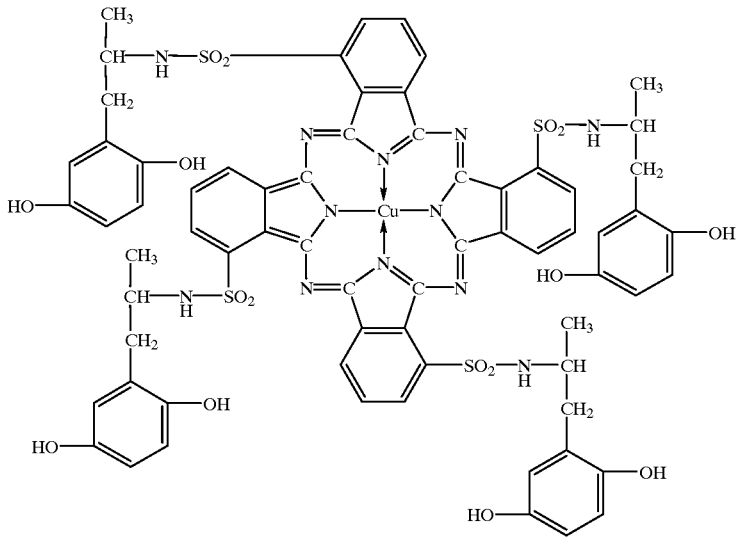

The image-receiving elements used in the peel-apart film units described above comprised a white-pigmented polyethylene-coated opaque photographic film support having coated thereon in succession:

1. a polymeric acid-reacting layer coated at a coverage of about 21,522 mg/m$^2$ comprising a 1.2/1 ratio of AIRFLEX™465 (a vinyl acetate ethylene latex from Air Products Co.) and GANTREZ™ S-97 (a free acid of a copolymer of methyl vinyl ether and maleic anhydride from GAF Corp.);
2. a timing layer coated at a coverage of about 4950 mg/m$^2$ comprising 3 parts of a copolymer of diacetone acrylamide and acrylamide grafted onto polyvinyl alcohol and I part of an aqueous polymeric emulsion, i.e., aliphatic polyester urethane polymer commercially available under the tradename Bayhydrol PU-402A (Bayer);

N-hydroxymethyldimethylhydantoin and about 3 mg/m$^2$ of succindialdehyde;

4. a magenta dye developer layer comprising about 374 mg/M$^2$ of a magenta dye developer represented by the formula

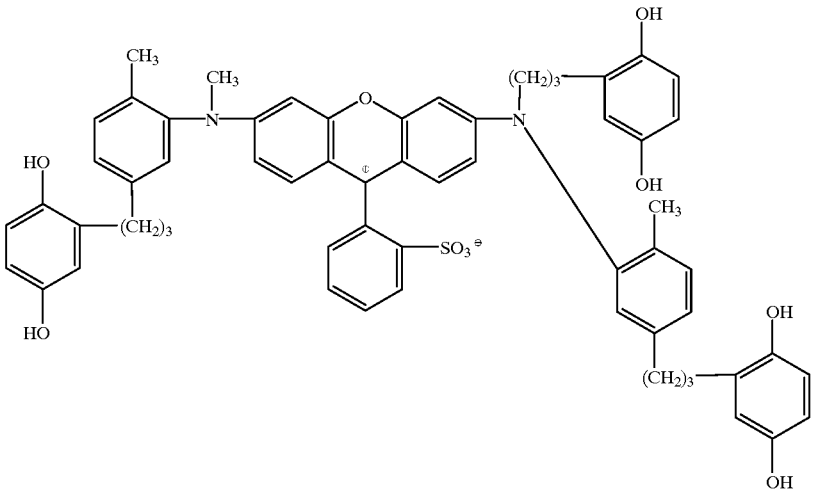

about 400 mg/m$^2$ of 2-phenyl benzimidazole, about 20 mg/m$^2$ of a cyan filter dye and about 248 mg/m$^2$ of gelatin;

5. a spacer layer comprising about 250 mg/$^2$ of carboxylated styrenebutadiene latex (Dow 620 latex) and about 83 mg/m$^2$ of gelatin;

6. a green-sensitive silver iodobromide layer comprising about 236 mg/m$^2$ of silver iodobromide (0.6 $\mu$m), about 33 mg/m$^2$ of silver iodobromide (1.1 $\mu$m), about 378 mg/m$^2$ of silver iodobromide (1.3 $\mu$m) and about 437 mg/m$^2$ of gelatin;

7. a layer comprising about 100 , mg/m$^2$ AMNHQ, about 20 mg/m$^2$ of bis (6-methylaminopurine), about 75 mg/m$^2$ of 6-hydroxy-4,4-5,7,8-pentamethyl-3,4-dihydrocoumarin and about 73 mg/m$^2$ of gelatin;

8. an interlayer comprising about 1448 mg/m$^2$ of the copolymer described in layer 3 and about 76 mg/m$^2$ of polyacrylamide;

9. a layer comprising about 100 mg/m$^2$ of a scavenger, 1-octadecyl-4,4-dimethyl-2-[2-hydroxy-5-(N-(7-caprolactamido)sulfonamido-phenyl] thiazolidine, about 20 mg/m$^2$ of a magenta filter dye and about 440 mg/m$^2$ of gelatin;

10. a yellow filter layer comprising about 280 mg/m$^2$ of a benzidine yellow dye and about 105 mg/m$^2$ of gelatin;

11. a yellow image dye-providing layer comprising about 910 mg/m$^2$ of a yellow image dye-providing material represented by the formula

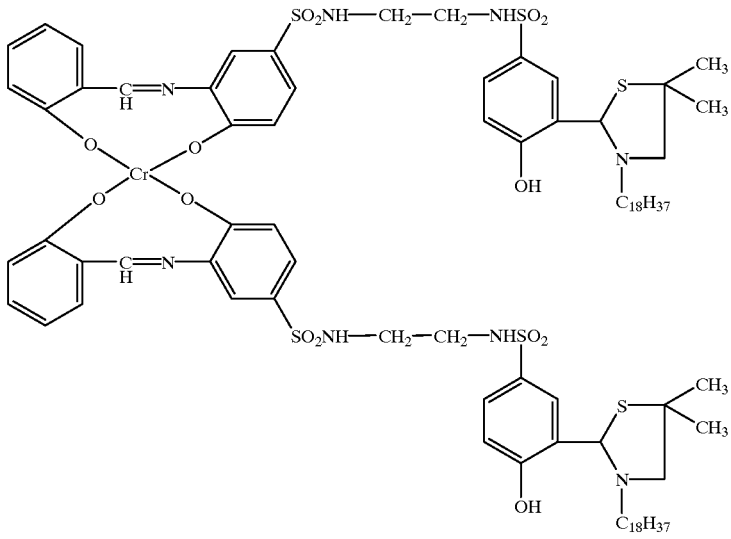

and about 364 mg/m$^2$ of gelatin;

12. a layer coated at a coverage of about 850 mg/m$^2$ of a hydrogen-bonded complex of norbornyltertiarybutyl hydroquinone (NTBHQ) and dimethylterephthalamide (DMPTA) and about 350 mg/m$^2$ of gelatin;
13. a blue-sensitive silver iodobromide layer comprising about 81 mg/m$^2$ of silver iodobromide (1.2 $\mu$m), about 189 mg/m$^2$ of silver iodobromide (2.0 $\mu$m) and about 135 mg/m$^2$ of gelatin; and
14. a layer comprising about 400 mg/m$^2$ of an ultraviolet filter material, Tinuvin (Ciba-Geigy), about 200 mg/m$^2$ ditertiarybutyl hydroquinone (DTBHQ), about 50 mg/m$^2$ of a releasable antifoggant

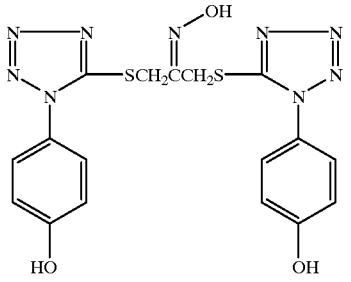

about 80 mg/m$^2$ of a benzidine yellow filter dye and about 73 mg/m$^2$ of gelatin.

The example film units were prepared utilizing the image-receiving elements and photosensitive elements as described above. In each case, after photoexposure of the photosensitive element, the image-receiving element and the photosensitive element were arranged in face-to-face relationship, i.e., with their respective supports outermost, and a rupturable container, i.e., a pod, containing an aqueous alkaline processing composition was affixed between the image-receiving and photosensitive elements at the leading edge of each film unit such that the application of compressive pressure to the container would rupture the seal of the container along its marginal edge and distribute the contents uniformly between the respective elements.

The chemical composition of the aqueous alkaline processing composition incorporated in Control-2, and utilized for the processing thereof, is set forth in TABLE II below.

TABLE II

| COMPONENT | PARTS BY WEIGHT |
|---|---|
| boric acid | 0.710 |
| n-(phenylmethyl)-1H-purin-6-amine | 0.025 |
| 6-methyl-2,4-(1H,3H)-pyrimidinedione | 0.448 |
| 5-amino-1-pentanol | 2.052 |
| 1H-1,2,4-triazole | 0.302 |
| 2-methyl-H-imidizole | 0.003 |
| hypoxanthine | 0.821 |
| 1-methyl-1H-imidizole | 0.244 |
| p-hydroxyphenylmercaptotetrazole | 0.004 |
| guanine | 0.123 |
| hydrophobically-modified hydroxyethylcellulose | 2.953 |
| 1-ethyl-cyclohexenopyridinium tosylate | 4.011 |
| potassium hydroxide | 2.40 |
| titanium dioxide | 0.084 |
| water | balance to 100 |

The aqueous alkaline processing composition incorporated in the Test-5 film unit was the same as that of TABLE II except that, per the novel processing composition disclosed herein, included about 0.20% by weight of a stabilizing agent, Joncryl 87.

Both of the diffusion transfer photographic film units prepared above were "aged" at about 60° C. for about fourteen days which is equivalent to about two years of aging, such as, for example, the time spent sitting on a shelf prior to use.

Each film unit, after exposure to a sensitometric target, was passed through a pair of rollers set at a gap spacing of about 0.0034 inch (0.0864 mm) and, after an imbibition period of about 90 seconds, the photosensitive and image-receiving elements were separated from each other.

The red, green and blue maximum ($D_{max}$) and minimum ($D_{min}$) reflection densities were read on a MacBeth Densitometer, and the data therefrom are reported in TABLE III.

TABLE III

| | RED | | GREEN | | BLUE | |
|---|---|---|---|---|---|---|
| FILM UNIT | $D_{max}$ | $D_{min}$ | $D_{max}$ | $D_{min}$ | $D_{max}$ | $D_{min}$ |
| Control-2 | 2.20 | 0.10 | 2.12 | 0.13 | 1.65 | 0.11 |
| Test-5 | 2.22 | 0.10 | 2.13 | 0.13 | 1.64 | 0.12 |

It will be understood by those of skill in the art from the $D_{max}$ data reported in TABLE III that both Control-2 and Test-5 allow sufficient image dye-providing materials to diffuse to the image-receiving layer. Also, it can be seen from the $D_{min}$ data of TABLE III that both Control-2 and Test-5 provide photographs with acceptable backgrounds.

In addition to the beneficial effects described above, and as determined upon visual examination and handling of the finished photographs obtained from the "Test-5" diffusion transfer photographic film unit of this Example, the use of a stabilizing agent of the invention substantially diminished the undesirable effects of light piping, such as, for example, the image along the edges of the photograph appearing to be unfocused and tattered, and brownish edges, and substantially eliminated the settling of titanium dioxide particles onto the image-receiving layer of the film unit, as compared to the "Control-2" film unit which did not contain the subject stabilizing agent.

Thus, as indicated by the data reported in TABLE III and the visual examination and handling of the finished photographs, the subject processing composition prevents light piping and the random settling of titanium dioxide particles onto the image-receiving layer without hindering dye transfer or negatively affecting desirable rheological properties, such as, for example, those properties critical to suitable spreading of the processing composition.

Since certain changes may be made in the above subject matter without departing from the spirit and scope of the invention herein involved, it is intended that all matter contained in the above description and the accompanying example be interpreted as illustrative and not in any limiting sense.

I claim:

1. A diffusion transfer photographic film unit comprising a photosensitive element comprising a support carrying at least one silver halide emulsion layer associated with an image dye-providing material;

a second sheet-like element which is in superposed relationship or adapted to be placed in superposed relationship with said photosensitive element;

an image-receiving layer positioned in one of said photosensitive and second sheet-like elements; and means providing an aqueous alkaline processing composition for distribution between predetermined layers of said elements, said aqueous alkaline processing composition comprising an aqueous alkaline medium having a pH in excess of 10 and including titanium dioxide particles and a stabilizing agent therein, said stabilizing agent comprising a polymer polymerized from a monomer system comprising: repeating units of styrene and repeating units of an acrylic acid.

2. A photographic film unit as defined in claim 1 wherein said photosensitive element comprises a red-sensitive silver halide emulsion layer in association with a cyan image-dye-providing material, a green-sensitive silver halide emulsion layer in association with a magenta image dye-providing material and a blue-sensitive silver halide emulsion layer in association with a yellow image dye-providing material.

3. A photographic film unit as defined in claim 2 wherein said stabilizing agent is represented by the formula

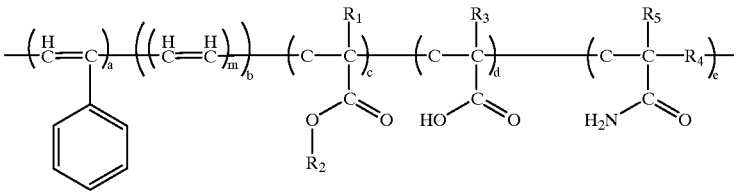

wherein:

$R_1$, $R_3$, and $R_5$ are each independently a hydrogen atom or alkyl, represented by $C_nH_{2n+1}$ where n is an integer of from 1 to 4;

$R_2$ is alkyl represented by $C_pH_{2p+1}$ where p is an integer of from 1 to 10;

$R_4$ is alkyl represented by $C_qH_{2q+1}$ where q is an integer of from 1 to 12;

a is an integer of from about 500 to about 20,000;

b is an integer of from 0 to about 14,000;

c is an integer of from 0 to about 6000;

d is an integer of from about 50 to about 1000;

e is an integer of from 0 to about 6000; and m is 1 or 2.

4. A photographic film unit as defined in claim 3 wherein said stabilizing agent comprises from about 30% to about 90% by weight of styrene, from about 1% to about 10% by weight of an acrylic acid, from 0% to about 70% by weight of ethylene or butadiene, from 0% to about 30% by weight of an acrylate and from 0% to about 10% by weight of an aminoacrylate.

5. A photographic film unit as defined in claim 4 wherein said stabilizing agent comprises comprises from about 3.5% to about 4% by weight of an acrylic acid, from about 56% to about 56.5% by weight of butadiene and about 40% by weight of styrene.

* * * * *